US008479636B2

(12) United States Patent
Rüb

(10) Patent No.: US 8,479,636 B2
(45) Date of Patent: Jul. 9, 2013

(54) VALVE ARRANGEMENT

(75) Inventor: Winfried Rüb, Waldshut-Tiengen (DE)

(73) Assignee: Hydac Filtertechnik GmbH, Salzbach/Saar (DE)

( * ) Notice: Subject to any disclaimer, the term of this patent is extended or adjusted under 35 U.S.C. 154(b) by 780 days.

(21) Appl. No.: 12/449,929

(22) PCT Filed: Jan. 18, 2008

(86) PCT No.: PCT/EP2008/000362

§ 371 (c)(1),
(2), (4) Date: Sep. 3, 2009

(87) PCT Pub. No.: WO2008/116515

PCT Pub. Date: Oct. 2, 2008

(65) Prior Publication Data

US 2010/0018198 A1 Jan. 28, 2010

(30) Foreign Application Priority Data

Mar. 27, 2007 (DE) ..... 10 2007 014 550

(51) Int. Cl.
*F15B 11/00* (2006.01)

(52) U.S. Cl.
USPC ..... 91/518; 60/426; 91/446

(58) Field of Classification Search
USPC ..... 60/422, 426, 420; 91/517, 518, 446
See application file for complete search history.

(56) References Cited

U.S. PATENT DOCUMENTS

| | | | | |
|---|---|---|---|---|
| 5,056,312 | A | 10/1991 | Hirata et al. | |
| 5,134,853 | A * | 8/1992 | Hirata et al. | 60/420 |
| 5,640,892 | A * | 6/1997 | Kauss et al. | 91/447 |
| 5,784,944 | A * | 7/1998 | Tozawa et al. | 91/361 |
| 7,219,591 | B2 * | 5/2007 | Loedige et al. | 91/433 |
| 2007/0137192 | A1 * | 6/2007 | Thiry et al. | 60/466 |

FOREIGN PATENT DOCUMENTS

| | | | |
|---|---|---|---|
| DE | 34 28 403 | A1 | 4/1985 |
| DE | 91 06 442 | U1 | 8/1991 |
| DE | 40 36 720 | C2 | 5/1992 |
| DE | 42 35 709 | A1 | 4/1994 |
| DE | 196 15 593 | B4 | 10/1997 |
| DE | 10 2004 005 606 | B3 | 10/2005 |
| DE | 10 2005 050 169 | A1 | 12/2006 |
| EP | 0 366 815 | B1 | 11/1989 |
| EP | 0 935 713 | B1 | 8/1999 |
| EP | 1 584 823 | A1 | 10/2005 |
| JP | 01 006501 | A | 1/1989 |
| WO | WO 90/10795 | A1 | 9/1990 |

* cited by examiner

*Primary Examiner* — Edward Look

*Assistant Examiner* — Michael Quandt

(74) *Attorney, Agent, or Firm* — Roylance, Abrams, Berdo and Goodman LLP

(57) ABSTRACT

A valve arrangement has an adjustable control valve (10) including a control slide (12) for actuating at least one consumer connection (A, B) and an LS control line. The differential pressure of two actuating pressures ($x_a$, $x_b$) serves for the actuation of the control slide (12). Since the actuating pressures ($x_a$, $x_b$) also actuate a logic valve, which in turn influences an additional valve, and/or actuates a pressure compensator connected upstream to the control valve (10), the difference of the two actuating pressures ($x_a$, $x_b$) initially displaces the control slide of the control valve. The higher or the lower of the two actuating pressures ($x_a$, $x_b$) either actuate the further valve in the form of the additional valve, and/or influences the pressure compensator.

7 Claims, 4 Drawing Sheets

VALVE ARRANGEMENT

FIELD OF THE INVENTION

The invention relates to a valve arrangement being an adjustable directional control valve with a control slide for actuating at least one consumer connection and with an LS control line. The pressure difference of the two actuating pressures $x_a$, $x_b$ is used to actuate the control slide.

BACKGROUND OF THE INVENTION

Valve arrangements of the indicated type are being increasingly designed as valve modules permitting acquiring a certain number of special alternative embodiments, in addition to implementation of standard alternative embodiments. Generally these special alternative embodiments increase the construction effort for producing the alternative embodiment itself using the installation space available within the standard valve module.

One typical case for electrically controlled valves is the desire of the user to be able to execute a pressure switching function or independently operated switching functions, besides controlling the directional control valve. For example, the function of "quantitative cutoff" is desired in which by pressure limitation in the control of a section compensator the control cross section of the compensator in the inflow to the slide diaphragm of the directional control valve is closed. Currently solutions are possible in which these valves are offered with setscrews for maximizing and setting inflow pressure to the two consumer connections (pipe connections) A and/or B. The setscrews are generally adjusted by hand and are accompanied by interruptions in operation on the machine.

Electrical adjustment by setting a potentiometer would be a desirable improvement. In the prior art, mobile directional control valves are known implementating such an electrical adjustment function, but require three proportional magnets taking up much installation space on the pertinent machine. Furthermore, there are additional wiring costs for implementation of the required bus hardware.

EP 0 935 713 B1 discloses a valve arrangement for actuating a consumer with a directional control valve continuously adjustable and acting as an inflow throttle, via which a pump connection can be connected to the consumer connections A, B. The respective consumer is connected to the directional control valve via working lines. In each working line there is a throttle to set the volumetric discharge flow of hydraulic oil by the consumer. In the known solution one control side of the throttle and one control side of the directional control valve at a time are each connected to one control unit at a time by a control channel. By two control units, the control pressures in the two control channels are adjustable independently of one another. When the inlet volumetric flow is set the two control pressures are greater than zero and the discharge-side throttle means can be completely opened independently of the valve slide position of the directional control valve, a valve arrangement is then devised in which with minimized hardware cost the energy losses can be minimized in the discharge from a consumer. The hydraulic volumetric flow is set by the directional control valve acting as an inflow throttle.

The throttle in the known solution also has two return throttles, each assigned to a consumer connection A or B. Each of these return throttles is provided with a tank connection T. A permanent connection is between the return throttles and the actuating pressures $x_a$, $x_b$, respectively, acting as an actuating pressure in the opposite direction on the control slide with the inflow diaphragm of the directional control valve. This directional control valve does not have a tank connection T in this regard. For this known solution, in addition to the control slide of the directional control valve, the respective return throttle is controlled by a total of two proportional magnets independent of one another and making available the indicated control pressures $x_a$, $x_b$. This known valve arrangement combined into a valve block is relatively large.

DE 10 2005 050 169 A1 discloses an LS control arrangement with a directional control valve having a valve slide. When the valve slide is set in one direction, a first consumer connection A is connected to inflow connection P and the second consumer connection B is connected to discharge connection T. When the valve slide is set in the other direction, second consumer connection B is connected to one inflow connection P and other consumer connection A is connected to a discharge connection T. By the inflow control edge, the opening cross section of an inflow metering orifice is determined and in turn is assigned an individual compensator for keeping the pressure drop constant over the inflow metering orifice. With an LS control oil flow path via which the load pressure can be tapped downstream from the inflow metering orifice and can be reported through the valve slide into the LS control chamber of the directional control valve, a maximum pressure in the LS control oil flow path is limitable by a pressure limitation valve. In that in the known solution the LS control oil flow path during setting of the valve slide in one direction in succession or overlapping can be connected to two pressure limitation chambers to which one pressure limitation valve at a time can be assigned for LS pressure limitation, multistage inflow pressure limitation is possible. The load pressure also can be limited to different values in different stroke ranges of the valve slide. This ability is advantageous for certain tasks in mobile machinery. Continuous adjustment processes are, however, not possible with the known solution.

SUMMARY OF THE INVENTION

An object of the invention is to provide an improved valve arrangement with an adjustable directional control valve such that continuous adjustment of the valve arrangement is possible and little installation space is required.

This object is basically achieved by a valve arrangement where the actuating pressures $x_a$, $x_b$ for the directional control valve additionally actuate a logic valve which in turn acts on an additional valve and/or actuates a compensator connected upstream from the directional control valve to the control slide. The difference of the two actuating pressures $x_a$, $x_b$ first closes the control slide of the directional control valve. One of the two actuating pressures $x_a$, $x_b$ either actuates the additional valve and/or acts on the compensator. The two proportional magnets intended preferably for making available the actuating pressures $x_a$, $x_b$ are operated at the same time. The choice of the pilot pressure as the actuating pressure $x_a$, $x_b$ takes place by a logic valve designed preferably as a selector valve or inverted selector valve.

In one preferred embodiment of the valve arrangement according to the invention, the additional valve is a pressure limitation valve DBV, in particular an LS-DBV. Since actuating a high pressure limitation valve takes place with low pressure, preferably a pressure intensification stage is interposed. The other valve or additional valve can also be designed as a corresponding check valve RV. Again pressure intensification is necessary for unblocking of this high pressure RV.

To be able to equalize valve tolerances arising due to the sequence of control edges on the directional slide and the interplay with the opening point of the check valve RV, preferably a counterpressure ($x_a$, $x_b$) is used to calibrate the opening point of a directional control valve axle to the RV. Possible calibration values can be stored by integrated valve electronics. In this case there is no choice between the higher or lower pilot pressure since the respectively pilot-operated check valve RV is assigned to only one pilot pressure at a time so that the RV assumes the function of the logic valve.

With the invention installation space can be saved. With only a few reliable components, "quantitative cutoff" can be electrically undertaken and adjusted. Another possible application involves support pressure control in which the support force of an implement can be reduced. This reduction applies, for example, in the reciprocating finger bar movers of slope mowers, reel guides of combine harvesters, packers on tractors, etc.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
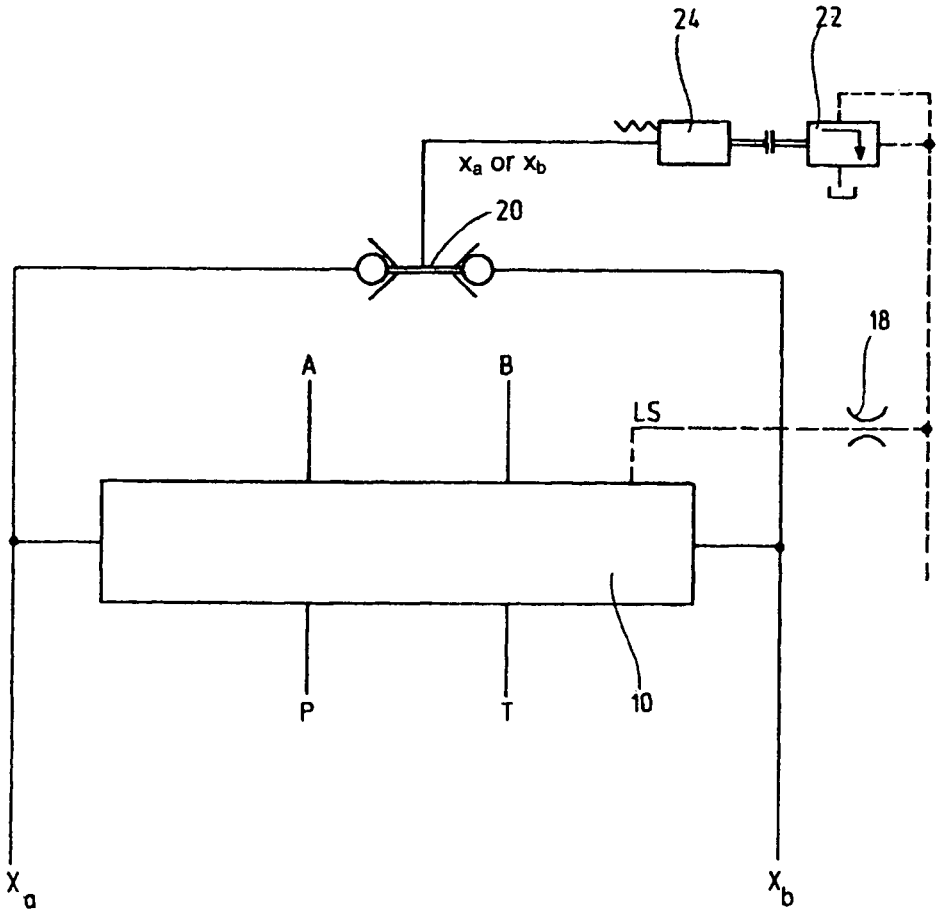
FIGS. 1 to 4 are schematic diagrams of the valve arrangement according to first, second, third and fourth exemplary embodiments, respectively, of the invention, with FIG. 1 relating to the basic structure of the valve arrangement.

Thus FIG. 1 shows a valve arrangement with an adjustable directional control valve 10 with a control slide 12 (FIG. 2 et seq.) for actuating two consumer connections A, B. The structure of these adjustable directional control valves 10 with the control slide 12 has been sufficiently known in the prior art (EP 0 935 713 B1, DE 10 2005 050 169 A1) such that further detailed description is unnecessary. The directional control valve 10 is connected to a pressure supply source P, for example in the form of a constant pressure pump taking hydraulic medium from a reservoir, for example in the form of a tank. The hydraulic medium flows via a tank connection T after passing through the hydraulic circuit back into the indicated reservoir. In these embodiments of the valve arrangement according to the invention, the directional control valve 10 has the pertinent tank connection T.

Figure 2:
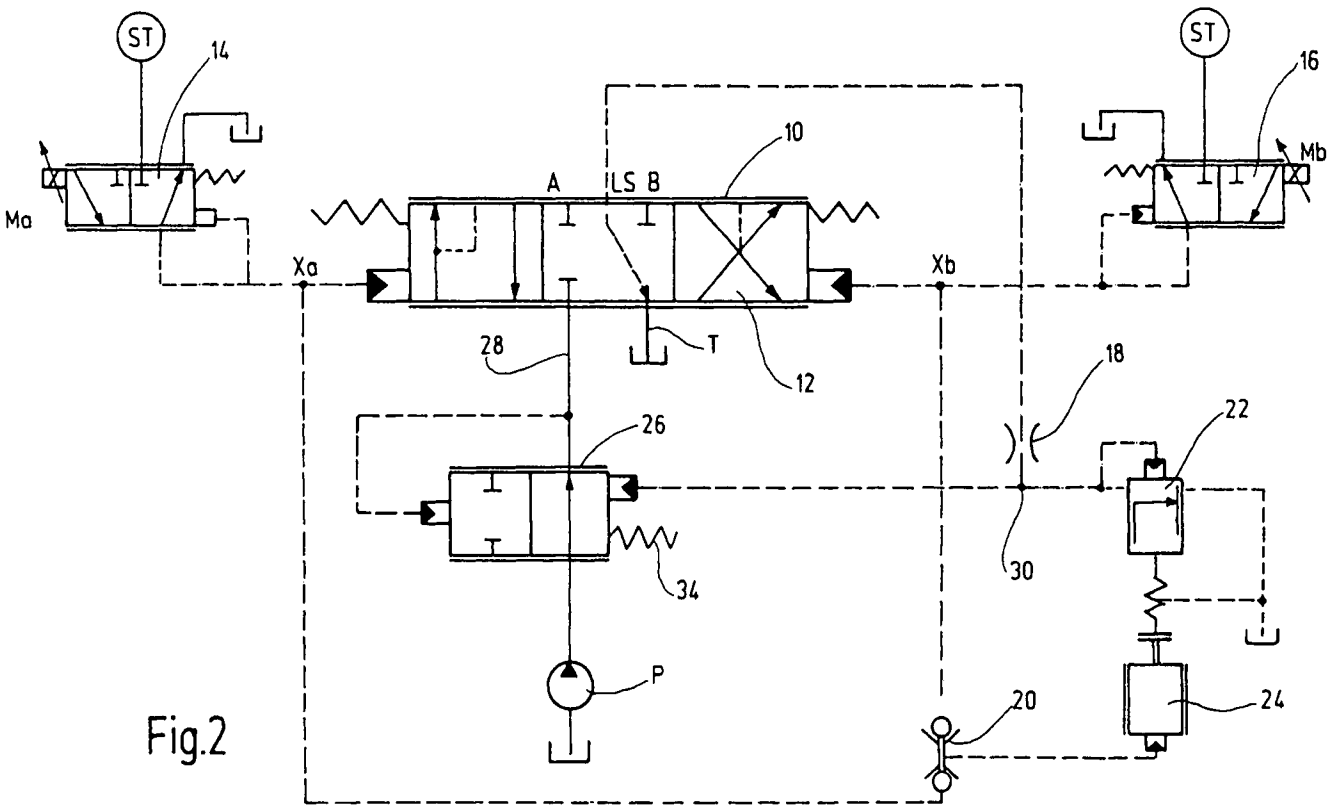
Figure 3:
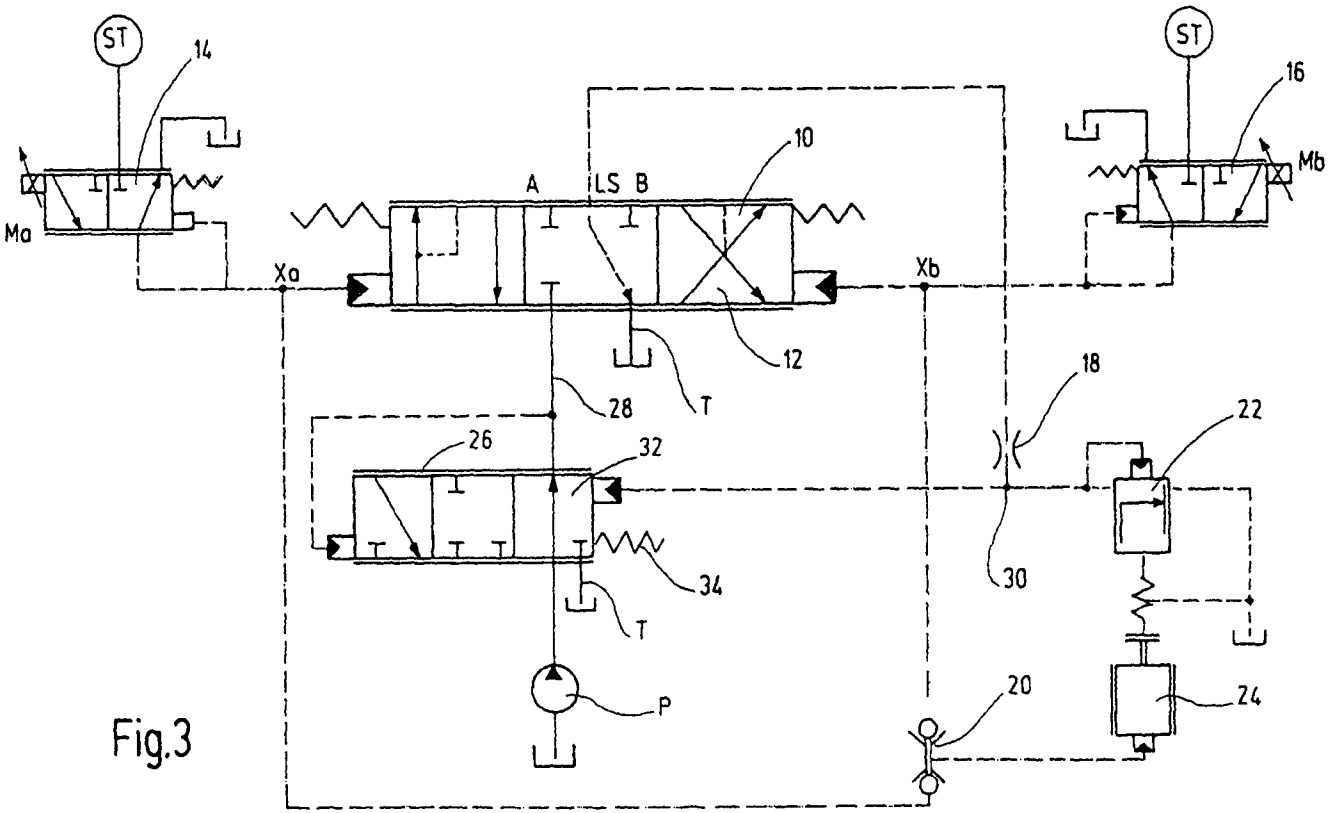
Figure 4:
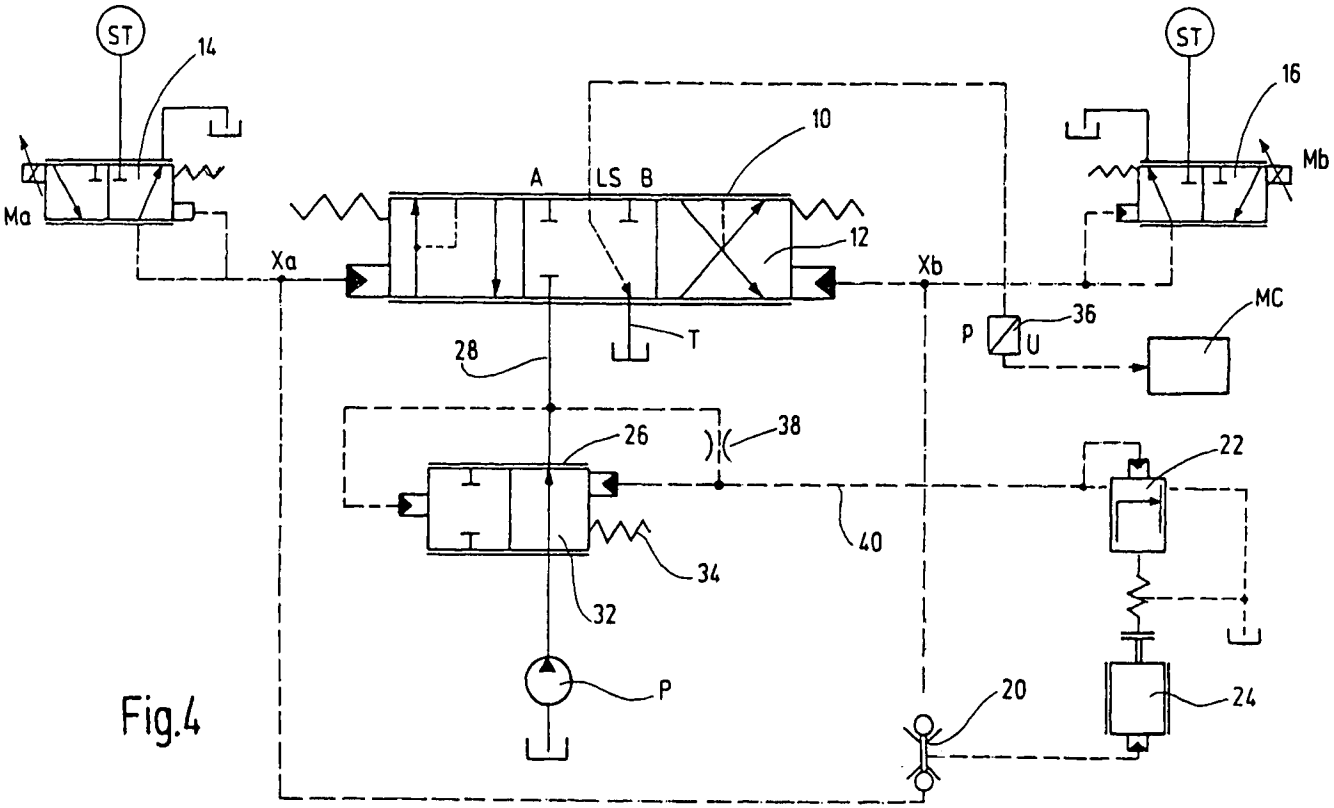

The directional control valve 10 also has an LS control line shown in the drawings by LS. To actuate the control slide 12, a pressure difference of the two actuating pressures $x_a$, $x_b$ is conventionally dictated by two pilot valves 14, 16 with actuators $M_a$ and $M_b$, respectively, in a manner not described in detail. The pilot valves 14, 16 are shown in FIGS. 2-4. The connection ST refers to the control pressure (conventionally 20 to 40 bar) in the control oil circuit used in particular to supply low pressure consumers not described in detail. The LS control line as shown in FIGS. 1 to 3 is provided with a throttle 18 or a diaphragm.

As FIGS. 2-4 show, the two actuating pressures $x_a$, $x_b$ act in the opposite directions on the control slide 12 of the directional control valve 10, and are connected in opposite acting directions to a logic valve 20, preferably designed as a selector valve and according to these details designed especially preferably as a selector valve acting in an inverted manner (i.e., opening the side with the lower pressure and closing the side with the higher pressure). The actuating pressure $x_a$ acting on the control slide 12 enables a fluid-guiding connection or fluid communication between the connections P and A. The actuating pressure $x_b$ acts on the control slide 12 in the opening direction of the connections P and B to be connected to one another in fluid communication. If an actuating pressure $x_a$, $x_b$ is not acting or the actuating pressures $x_a$, $x_b$ are mutually cancelled in terms of their differential pressure, the control slide 12 assumes its spring-centered middle position as is shown in FIGS. 2-4, which middle position is also referred to as the neutral position of the directional control valve 10.

Another valve in the form of an additional valve 22 is connected to the logic valve 20 and is designed as a pressure limitation valve DBV. A pressure intensification stage 24 is connected upstream from the pressure limitation valve DBV on the input side and permits the input pressure from the output side of the logic valve 20 to a higher pressure relative to the input side of the additional valve 22. In this way, improved efficiency of actuation to use the low pilot pressure $x_a$ or $x_b$ to actuate the additional valve 22 is obtained.

With the basic setup shown in FIG. 1, the "quantitative cutoff" in a continuous manner can be carried out, and/or appropriate support pressure control for an implement, connected to user or consumer connections A, B can be achieved. Advantageously, in addition to the logic valve 20 and the additional valve 22 shown in FIG. 2, a compensator 26 is connected on the pump input side of the directional control valve 10 between the pressure supply source P and the pertinent input of the directional control valve 10. The compensator is connected on its one control input side to the pertinent supply line 28 and on the oppositely acting control input side to a nodal point 30 into which the LS control line discharges, as well as a fluid connection for the additional valve 22 in the form of a pressure limitation valve with connected pressure intensification stage 24. According to the diagram in FIG. 2, with this valve arrangement an electrically actuatable "quantitative cutoff" with two simultaneously operated proportional pilot valves 14, 16 is achieved.

In this embodiment the additional valve 22 is designed as a LS pressure limitation valve (LS-DBV) and is supplied by the LS pressure of the LS control line and in this respect actuates the section compensator 26 connected upstream from the control slide 12 of the directional control valve 10. The LS-DBV 22 is actuated by the lower of the two actuating pressures $x_a$, $x_b$ on its spring side. In turn the selection of the actuating pressures $x_a$, $x_b$ takes place by the inverted selector valve as a logic valve 20. Since conventionally the control slide 12 is deflected with a lower actuating pressure $x_a$, $x_b$, this low pressure must also control the high pressure LS-DBV as an additional valve 22. A pressure intensification stage 24 is used for this purpose and connected between the logic valve 20 and the spring chamber of the LS-DBV. The pressure boosting piston (not shown) is designed such that with its large surface adjoins the actuating pressure and the small surface adjoins the spring chamber of the LS-DBV. With this design electrically adjustable quantitative cutoff is advantageously possible.

The following exemplary embodiments are explained only to the extent that they differ significantly from the preceding embodiments. The same reference numbers are used for the same components of the valve arrangement and the details described above also apply in this respect to the embodiments as shown in FIGS. 3 and 4 which are still to be presented.

For support pressure control in the valve arrangement shown in FIG. 3, the section compensator 26 has a tank connection T. This tank connection T of the compensator 26 can only be opened when the compensator piston 32 in movement against the control spring 34 has first moved to one of three positions of almost completely closed the supply channel P (supply line 28) or is just closing it or has already closed it. Not only can pressure limitation in the inflow to the respective pipe connection (consumer connection A, B) then be achieved, but also pressure control. The support force of a device of a machine (not shown) on the ground can be reduced by the section compensator 26 on the one hand being able to control a volumetric flow to the respective consumer connection A, B, but also from the respective consumer connection A, B to the tank connection T with the control slide 12 opened. With the embodiment as shown in FIG. 3 electrically actuatable quantitative cutoff with support pressure control is thus possible.

In the embodiment as shown in FIG. 4 the nodal point 30 with the throttle 18 or the diaphragm 18 is omitted and the LS control line is connected by a pressure sensor 36 to a microprocessor or microcontroller MC of the valve electronics (not detailed). The control input sides of the compensator 26 are connected to the supply line 28. In one of the supply lines, an additional diaphragm or throttle 38 is used. The indicated control line discharges by this throttle 29 into the connecting line 40 between the additional valve 22 and the actuating side of the compensator 26. Accordingly, the other valve is designed as an additional valve 22 in the form of a LS pressure control valve not supplied by LS pressure in the LS control line but by the pressure of the pressure supply source P. In the spring space of the section compensator 26, the LS pressure control valve 22 produces an artificial load pressure which can be varied from a value of zero to Pmax. Regardless of the actual load pressure, this pressure difference can be electrically set almost at will. In this way precision control at a low pressure difference and maximum pump quantity over the section is possible at the maximum pressure difference. The load pressure is measured by a pressure sensor 36 that relays the pressure value to a microprocessor or microcontroller MC as a component of the valve electronics (not detailed). The valve electronics then control the low actuating pressure after stipulating an external setpoint, and at the same time, correct the higher actuating pressure by zero point correction of the lower actuating pressure.

Another advantageous use of these solutions involves providing a control unit (not shown) of a certain nominal width, in which only a single consumer connection (A, B) requires a larger nominal width. For saving costs, the smaller control block can be retained because the necessarily large amount can be achieved by a high pressure difference on the metering diaphragm, formed by the input side of the valve slide 12 (input of the supply line 28). While various embodiments have been chosen to illustrate the invention, it will be understood by those skilled in the art that various changes and modifications can be made therein without departing from the scope of the invention as defined in the appended claims.

What is claimed is:

1. A valve arrangement, comprising:

an adjustable directional control valve having a control slide actuating at least one consumer connection, being actuated by a pressure difference of two actuating pressures and having an input side;

an LS control line connected to said control valve;

a logic valve in fluid communication with said control valve and actuated by the two actuating pressures, said logic valve being a selector valve acting in an inverted manner;

an additional valve in fluid communication with said logic valve and being an LS pressure limitation valve actuated by said logic valve;

a pressure compensator in fluid communication with and upstream of said control valve, between a pressure supply and said input side and connected on a control input thereof to a supply line connecting said control valve and said pressure compensator;

a connection line connecting said pressure compensator to said LS pressure limiting valve;

one of a throttle and diaphragm in a delivery line extending from said supply line to said connection line; and a pressure sensor connected to said LS control line and to valve control electronics.

2. A valve arrangement according to claim 1 wherein said additional valve is actuatable by a pressure intensification stage receiving pressure from an output of said logic valve.

3. A valve arrangement according to claim 1 wherein said LS control line is connected via said pressure sensor to a microprocessor of said valve control electronics.

4. A valve arrangement according to claim 1 wherein first and second pilot valves are connected to said control valve and respectively and separately provide the actuating pressures to said control valve.

5. A valve arrangement according to claim 4 wherein said LS control line is connected via said pressure sensor to a microprocessor of said valve control electronics.

6. A valve arrangement according to claim 5 wherein said microprocessor actuates said pilot valves.

7. A valve arrangement according to claim 1 wherein said control valve comprises at least one tank connection.

* * * * *